US005374289A

United States Patent [19]

Campana

[11] Patent Number: 5,374,289

[45] Date of Patent: * Dec. 20, 1994

[54] FUEL PACKAGE

[75] Inventor: Patsie C. Campana, Lorain, Ohio

[73] Assignee: Caldo International, Inc., Lorain, Ohio

[ * ] Notice: The portion of the term of this patent subsequent to Mar. 1, 2011 has been disclaimed.

[21] Appl. No.: 105,410

[22] Filed: Aug. 12, 1993

Related U.S. Application Data

[63] Continuation of Ser. No. 821,077, Jan. 15, 1992, Pat. No. 5,290,326.

[51] Int. Cl.[5] ..... C10L 5/00; C10L 11/06

[52] U.S. Cl. ..... 44/519; 44/532; 44/533; 44/534

[58] Field of Search ..... 44/519, 532, 533, 534

[56] References Cited

U.S. PATENT DOCUMENTS

| | | | |
|---|---|---|---|
| 4,775,391 | 10/1988 | Antosko | 44/532 |
| 4,786,290 | 11/1988 | Wyer | 44/519 |
| 4,832,703 | 5/1989 | Campana et al. | 44/519 |
| 4,906,254 | 3/1990 | Antosko | 44/532 |
| 5,186,721 | 2/1993 | Campana | 44/532 |

*Primary Examiner*—Ellen M. McAvoy

*Attorney, Agent, or Firm*—Fay, Sharpe, Beall, Fagan, Minnich & McKee

[57] ABSTRACT

An ignition device for igniting an associated fuel, such as charcoal briquettes or firewood, includes a base, an ignitor, a wick, and an ignition cream. The base is planar and is made of a combustible material such as cardboard. The ignitor has a generally conical configuration and is attached to a top surface of the base. The ignitor is a thermite type material which includes aluminum and iron oxide. The wick is attached to the top surface of the base and extends between the ignitor and an edge of the base. The ignition cream can be made of the same material as the wick, both being ignitable with a match or cigarette lighter.

17 Claims, 3 Drawing Sheets

FUEL PACKAGE

This is a continuation of application Ser. No. 821,077, filed Jan. 15, 1992, now U.S. Pat. No. 5,290,326.

BACKGROUND OF THE INVENTION

I. Field of Invention

This invention pertains to the art of ignitors for charcoal and other similar fuels such as wood, and, more particularly, to an improved ignitor wherein the ignitor is a clean, inexpensive substance not comprising petroleum distillates.

II. Description of the Related Art

The use of charcoal briquettes and similar fuels for outdoor cooking is well-known. Typically, one wishing to cook outdoors purchases charcoal and charcoal lighter fluid in combination. The charcoal is often difficult to kindle, even when using lighter fluid. Conventional charcoal lighter fluid, being a liquid, can be volatile and can present safety and fire hazards. Typical lighter fluid is a petroleum distillate which can cause serious burns, dangerous flame-ups, objectionable odors, poor tasting food, and ozone-layer affecting carbons.

Typical lighter fluid operates by soaking into the charcoal briquettes. Upon ignition, the lighter fluid burns away and the charcoal smolders until hot enough to provide proper heat for cooking. Generally, the procedure takes more time than is desirable.

Further, because of the safety problems recited above, lighter fluid is unacceptable as an igniting substance for use in home fireplaces.

To alleviate these and other problems, some self-kindling fuel packages have been sold. For example, Campana U.S. Pat. No 4,832,703 to Campana, et al. describes one such self-kindling fuel package in which a charge of fuel is held together within a container. The container is comprised of two elements which are folded together to create the container which receives the fuel.

Another example of a fuel package is Key, Jr. U.S. Patent No. 3,269,807, in which the fuel package comprises a basket formed of a plurality of staves. Within the staves is loaded a charge of fuel. The top of the basket is covered with a circular lid which features a tab.

Another example of a fuel package is Lynes U.S. Pat. No. 1,401,803 in which a wick extends without a box-like structure containing inflammable material.

Chaplin U.S. Pat. No. 2,834,661 discloses a self-kindling fuel package featuring a chimney section in the middle.

Finally, Kahill U.S. Pat. No. 4,460,377 features a hollow cardboard container in which charcoal or another similar fuel is stored and ignited with an ignitor.

SUMMARY OF THE INVENTION

In accordance with the present invention, a new and improved ignitor for use with a fuel is provided.

More particularly, in accordance with the present invention, the ignition device comprises a base, an ignitor, and a wick. The base is generally planar and has a top surface and a bottom surface. The base is made of a combustible material. The ignitor is attached to the top surface of the base and is made of a thermite type material which contains aluminum and iron oxide. The wick is attached to the top surface of the base and has first and second ends. The first end of the wick is attached to the ignitor.

According to another aspect of the invention, the wick comprises a composition of Al, Fe, Si, and $KClO_4$ and a polyurethane binder.

According to another aspect of the invention, an ignition cream having a mixture similar to that of the wick is affixed to the ignitor where the first end of the wick meets the ignitor.

According to another aspect of the invention, the ignitor has the general shape of a cone with the top portion of the cone truncated.

According to another aspect of the invention, the base is made of cardboard. Further, the ignitor is composed of particulates which are sized for a burning rate of between 5 seconds per inch and 60 seconds per inch. The wick is between 1 millimeter and 2 millimeters thick, and is resiliently flexible.

One advantage of the present invention is the provision of a new and improved igniting device which is capable of use in any of the ordinary types of non-gas, non-electric barbecue grills, fireplaces, wood stoves, campfires, and the like.

Another advantage of tile present invention is the provision of an igniting device which is clean, easily handled, kindles rapidly, and contains a charge of ignitor commonly sufficient for a single use.

Still another advantage of the present invention is the provision of an igniting device which eliminates the necessity for the use to handle charcoal lighter fluid and thereby soil his hands.

Another advantage of the present invention is the provision of a solid igniting material, obviating the necessity for the user to utilize volatile liquid lighter fluid. Lighter fluid can be ingested by children, can spill within a vehicle or home, and is associated with safety risks not present in the inventive device. For example, lighter fluid is prone to possible flame-up, thereby burning the face and hands of the user.

A further advantage of the present invention is the lack of an odor associated therewith. Lighter fluid has a heavy petroleum smell and can cause an unpleasant smell in the area as well as impart a poor taste to the food.

A yet further advantage of the present invention is its environmental safety. Carbons produced by combustion of petroleum distillates have been proven to be harmful to the ozone layer.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein.

DETAILED DESCRIPTION OF THE PREFERRED EMBODIMENT

Figure 1:
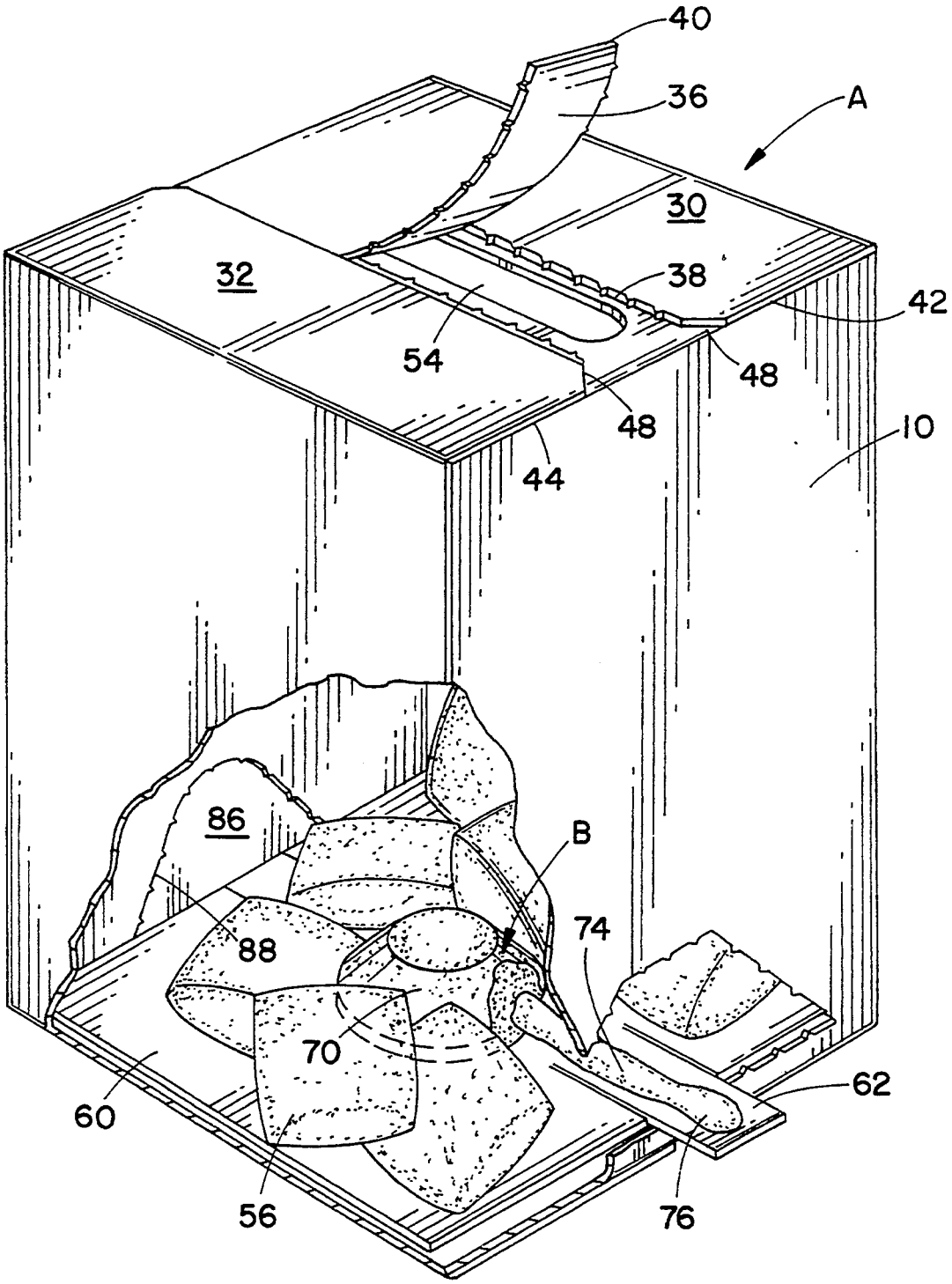
FIG. 1 is a perspective view, partially broken away, of a self-kindling fuel package showing fuel, the inventive ignition device, and a pull tab in an operative position.

Referring now to the drawings, wherein the showings are for purposes of illustrating a preferred embodiment of this invention only and not for purposes of limiting the same, FIG. 1 shows the subject new ignition device B within a fuel package A. While the fuel package A is primarily designed for and will hereinafter be described in connection with its use on a barbecue grill for kindling a charcoal fire thereon, it will be appreciated that the inventive ignition device B could be adapted for use in other environments where it is desired to start a fire such as in a wood stove, a fireplace, or a campfire.

In one embodiment, the ignition device B is used in conjunction with a container 10. With reference to FIG. 1, the container 10 is comprised of a plurality of planar surfaces. The container 10 is preferably made of a flat, continuous element 12. In the preferred embodiment, the planar surfaces are generally rectangular and comprise a top wall 14, a bottom wall 16, and four side surfaces 18, 20, 22, and 24. In the preferred embodiment, the top wall 14 and the bottom wall 16 are approximately square and the side walls 18, 20, 22, 24 are the same size and are taller than their width. This configuration assists in uniformly heating the fuel within the container 10. For example, because the height of the side walls 18, 20, 22, 24 is greater than the width, the fuel tends to be stacked in a pillar-like arrangement. Such an arrangement helps heat a large number of the fuel briquettes quickly in that heat tends to rise. Additionally, because the width of each side wall is approximately equal, the arrangement of the fuel briquettes within the container 10 tends to be symmetrical about a longitudinal axis passing through the center of the top wall 14 and bottom wall 16. As the briquettes burn the container 10 away, the briquettes tend to fall in a uniform symmetrical pattern conducive for uniform heating and ease of cooking.

Figure 5:
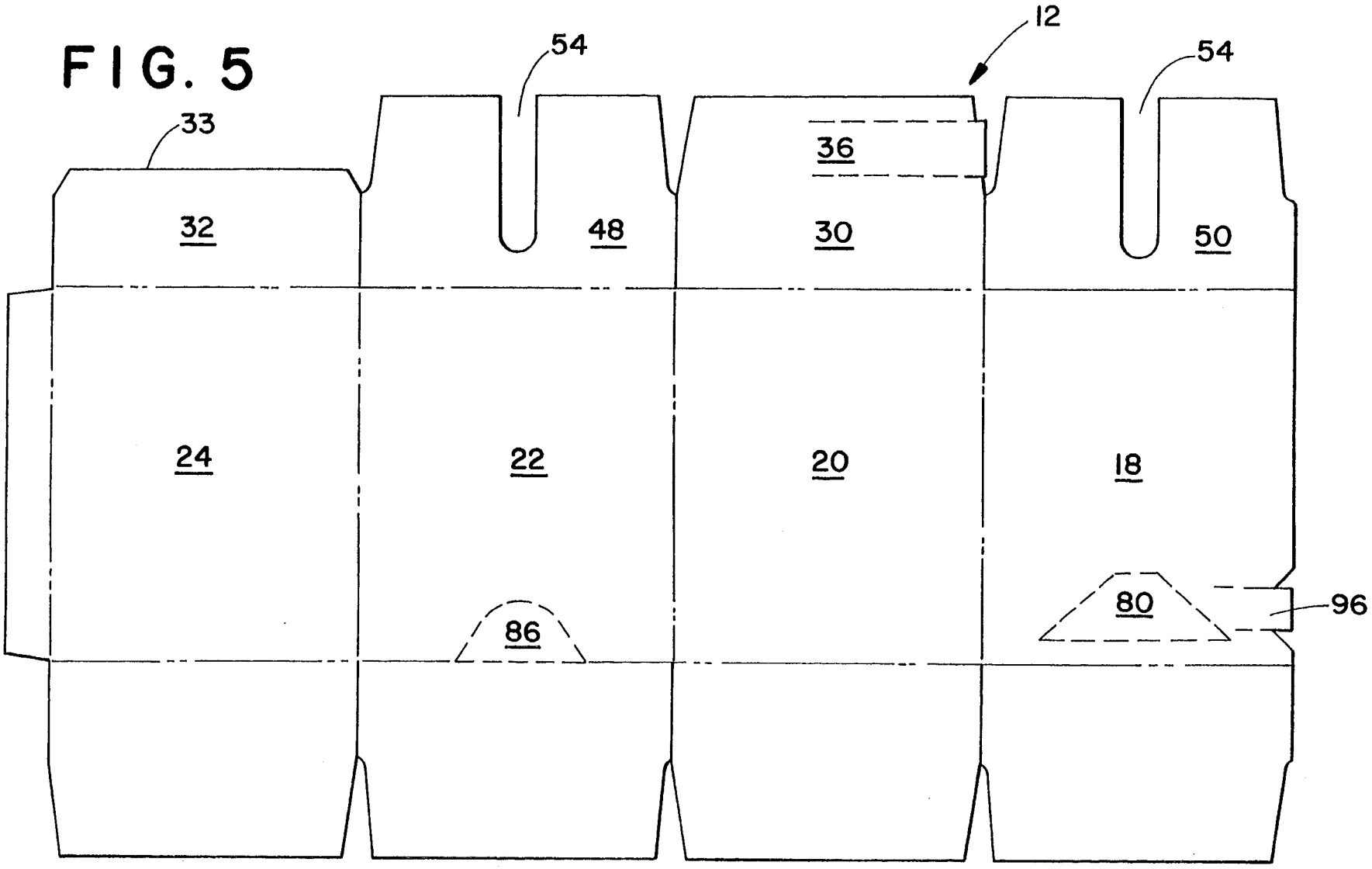

With reference to FIGS. 1 and 5, the top wall 14 is shown to comprise a first flap 30 and a second flap 32. As will be discussed later in the specification, the flaps are selectively folded together to comprise the top wall 14. The first flap 30 comprises a pull tab 36. The pull tab has edges 38 which are perforated to enable the pull tab to be torn open and lifted out of the plane of the first flap 30. A first end 40 of the pull tab 36 is located near an edge 42 of the first flap 30 and an edge 44 of the second flap 32. At both of these edges 42, 44, the corner has been cut at a bevel 48 to assist in the user gripping the first end 40 of the pull tab 36. The second flap 32 is shorter than the first flap 30, so that the edge 33 of the second flap 32 does not extend beneath pull tab 36.

With continuing reference to FIGS. 1 and 5, the container 10 is shown in a flattened, unfolded state. In addition to the first and second flaps 30, 32 of the top wall 14, there is illustrated third and fourth flaps 48, 50. When the first, second, third, and fourth flaps are folded together to comprise top wall 14, a slot 54 is located directly beneath pull tab 36. One half of the slot 54 is cut into the third flap 48 and one half of the slot 54 is cut into the fourth flap 50. The slot 54 provides ventilation at the top of the container 10 when the briquettes have been ignited and provides a drafting, chimney-like effect.

With continuing reference to FIG. 1, the fuel 56 is illustrated in the form of charcoal briquettes. While charcoal briquettes are the preferred fuel, other types of fuel can work equally as well. For example, another effective use of the ignition device B is in a fireplace to start firewood. In the preferred method, a log which is split in half is set horizontally into the fireplace with the flat edge upward. An ignition device B according to the invention is then placed on the flat surface of the split log. A second log is then placed on top of the igniting device B, creating a sort-of sandwich. When the igniting device is activated, it generates enough heat to light both logs.

Figure 2:
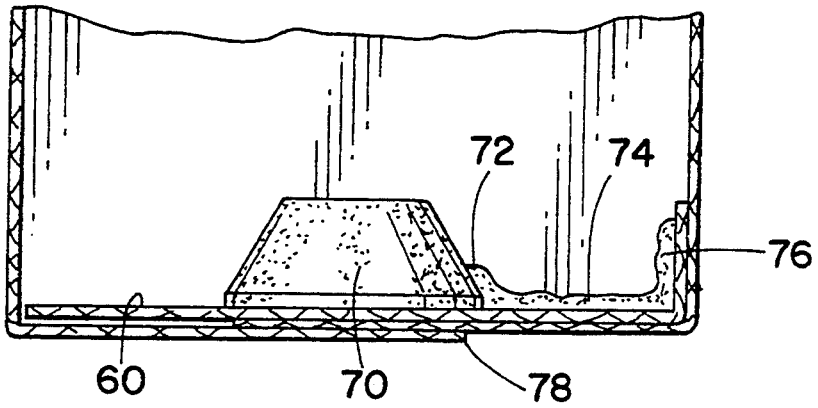
FIG. 2 is a side elevational cross-sectional view of an ignition device within a fuel package.
Figure 3:
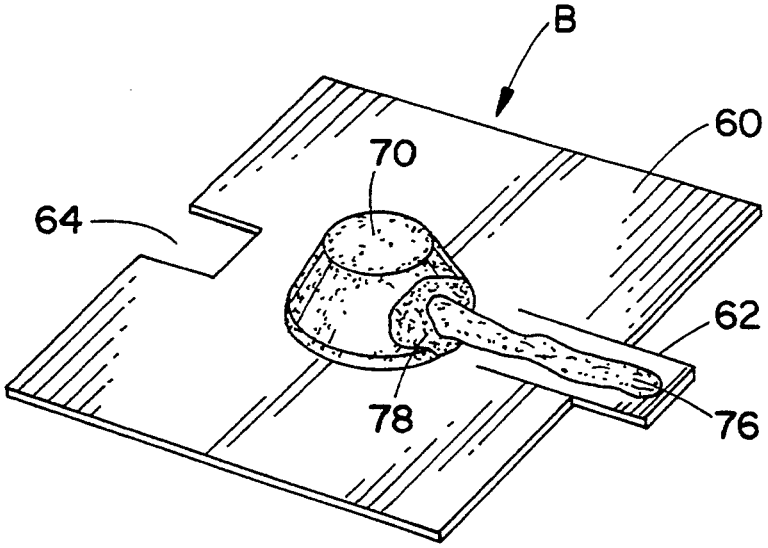
FIG. 3 is a perspective view of one embodiment of an ignition device according to the invention.

With reference to FIGS. 1–3, the preferred embodiment of the fuel package A contains a floor insert 60. The floor insert 60 is one embodiment of the inventive ignition device B. The floor insert 60 is received within the container 10 and is designed to fit on top of bottom wall 16. The floor insert 60 is cut with an extension 62 as well as a recess 64. The function of the extension 62 is to extend the wick beyond the confines of the container 10 as will be discussed later. The function of the recess 64 is to enable the extension 62 to be stamped out of an adjoining piece of cardboard with maximum material savings. For example, a large number of floor inserts 60 can be stamped out of a single rectangular piece of cardboard with minimal waste if the extension 62 of one floor insert 60 creates the recess 64 of the adjoining floor insert 60.

Figure 4:
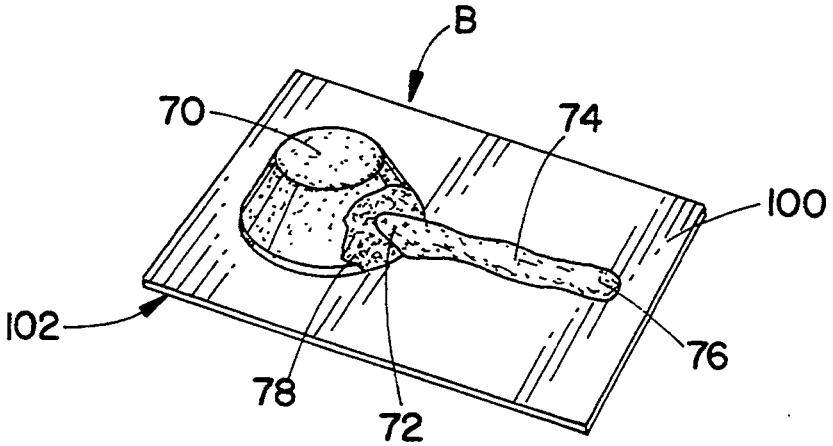
FIG. 4 is a perspective view of another embodiment of an ignition device according to the invention; and, FIG. 5 is a top plan view of a container according to the present invention in its unfolded state.

It is not believed that a floor insert 60 is required; instead, it may be preferable to place the ignition device B illustrated in FIG. 4 directly on the bottom wall 16 of the container 10. On the other hand, some manufacturing efficiencies may result from use of the configuration of the floor insert 60. For example, the ignition device B may be inconveniently placed directly on the bottom wall 16 in some applications or may shift its position during shipping.

With reference to FIG. 4, the preferred embodiment of the ignition device B is shown. In this embodiment, the ignition device B is suitably purchased by the user for use in a fireplace or in an outdoor grill with charcoal briquettes without purchase of the entire fuel package A.

The ignition device B essentially comprises an ignitor 70, a wick 74, an ignition cream 78 and a base 100. The chemical composition of the ignitor 70 will be discussed in more detail later in the specification, but its primary function is to ignite the fuel.

A first end 72 of the wick 74 is attached to the ignitor 70. The wick 74 is generally centered on the base 100. The wick 74 can be extruded from a mixture of its various components or, if desired, it can be formed by mixing it with or impregnating it into a suitable carrier. B Typical acceptable carrier materials include cotton, materials such as the strands of a floor mop, paper fabrics such as in paper towels, and paper materials impregnated with candle wax.

In the preferred embodiment, the ignition cream 78 may be used to attach the wick 74 to the ignitor 70 and to the base 100. In a preferred embodiment, the wick 74 and the ignition cream 78 have the same composition. The requirements of the wick 74 and ignition cream 78 are generally that they are ignitable with a match or a cigarette lighter, they are wind resistant, and they have sufficient heat generation ability so as to ignite the ignitor material 70. In the embodiment shown in FIGS. 1–3, a special requirement of the wick 74 is that it will flex without breaking, i.e., it must evidence a high degree of flexibility. The ignition cream 78 is typically applied to a thickness of approximately 2 millimeters or thicker. One preferred embodiment of ignition cream 78 was composed of ten grams Fe, ten grams Al, ten grams Si, sixty grams $KClO_4$, and thirty grams polyurethane resin binder, if desired. The Fe and Si can be added in the form of a ferrosilicon alloy. The polyurethane resin binder is preferably dissolved in hexane or hexane mixed with heptane. A presently preferred composition includes ten grams Al, twenty grams Fe, ten grams Si, forty grams $KClO_4$, and thirty grams of a polyurethane binder.

In the embodiment shown in FIGS. 1–3, when the container 10 is packaged for shipping, such as when it is on the shelf of a store, a second end 76 of the wick is folded, along with the extension 62, within the container 10, as is shown in FIG. 2. It is this folding which makes the requirement of flexibility necessary. When the fuel package A is ready for ignition, the extension 62, along with the second end 76 of the wick 74 is pulled outwardly through an opening 80 in the side wall 18 of the container 10. The opening 80 is created by removing or deflecting a portion of the side wall 18 defined by a series of perforations 82.

A second opening 86 is located in the side wall 22 on the opposite side of the first opening 80. The second opening 86 is also created be removing or deflecting a portion of side wall 22 via the use of a series of perforations 88 in that side wall 22. In one embodiment of the invention, a strip of common adhesive tape 90 is used to keep the second opening 86 closed until the fuel package A is to be used. In a second embodiment, a second tab 96 is formed into side wall 18 to facilitate the opening of the first opening 80, similar to the opening of the pull tab 36 in the top wall 14.

With reference to FIGS. 1, 2, and 3, the operation of the fuel package A is as follows: after the fuel package A is placed in an appropriate container, such as a charcoal grill, the pull tab 36 is deflected upwardly so that the perforated edges 38 tear. The pull tab 36 is deflected so that it stays in a second position, deflected from the plane of the top wall 14. This allows the slot 54 to be exposed. By exposing the slot 54, the fuel 56 is also exposed to the outside air. The slot 54 creates, in conjunction with first and second openings 80, 86, a draft which contributes to the quick ignition and burning of the fuel 56.

Next, the first opening 80 is opened, either by means of second tab 96 or by perforations 82. Upon removing or deflecting the portion of side wall 18 covering first opening 80, extension 62 and the second end 76 of the wick 74 are easily folded downwardly and outwardly of the container. After opening the second opening 86 in a similar fashion, the second end 76 of wick 74 can be ignited by a conventional match or cigarette lighter. The wick 74 burns in a steady and controllable fashion until it reaches the ignitor 70. At this point, the ignitor 70 ignites, creating a point of intense heat sufficient to ignite the fuel 56. The fuel 56 burns within the container 10 until the combustible container 10 material is consumed. When the container 10 has lost its structural rigidity, the fuel briquettes 56 tend to tumble into a generally symmetrical pattern conducive for heat transfer and good cooking performance.

The use of the preferred embodiment of the ignition device B as disclosed in FIG. 4 will now be discussed. The ignition device B as shown in FIG. 4 would typically be sold in a package containing several ignition devices B. The user would remove one of the ignition devices B and place it in the midst of the fuel to be ignited. If used in a charcoal briquette application, the charcoal briquettes would be piled on top of the ignition device B while allowing the second end 76 of the wick 74 to be exposed. The second end 76 of the wick 74 would then be ignited with a match or a cigarette lighter. When the wick 76 burned down to the ignition cream 78 and ignitor 70, the ignitor 70 would generate sufficient heat to ignite the charcoal briquettes. If the ignition device B was to be used in a fireplace or campfire situation, the preferred method is to take a first log which is split in half, and place flat on the ground or fireplace grate with the flat side up. The ignition device B is placed on the flat surface of the first split log so that the bottom surface 102 of the base 100 is in contact with the flat surface of the first log. Next, second split log, perhaps the other half of the first split log, is placed atop the ignition device B, forming a sandwich-like arrangement. The second end 76 of the wick 74 is allowed to protrude from between the logs. When the wick 74 has been ignited by means of a match or a cigarette lighter, the ignitor 70 generates sufficient heat to ignite tile logs.

Next, the composition of the ignitor 70 and the wick 74 will be discussed.

The ignitor 70 is fabricated from a special mixture of materials which include in weight percent from about 25% to 65% silica, from about 5% to 18% sodium nitrate, from about 1% to about 8% sodium hexafluorosilicate or cryolite, from about 15% to about 40% aluminum, and from about 2% to about 20% iron oxide.

The ignitor 70 is produced from a thermite type of material which contains aluminum and iron oxide (the general reaction mechanism being illustrated by the formula—$2Al+Fe_2O_3 \rightarrow Al_2O_3+2Fe$) to which has been added various other materials for the purpose of controlling the rate of the thermite reaction. In this regard, the above-described formulation results in an ignitor 70 which is exceptionally well-suited for the practice of the instant invention. In the proper circumstances, it may be possible to control the rate of the thermite reaction by using materials other than those specified above. For example, various clays or charcoal may be substituted for the silica. The individual components which make up the ignitor 70 are mixed together with a suitable binder, such as sodium silicate, and formed into the desired configuration by conventional means.

The preferred composition used as the ignitor 70 comprises, in weight percent, about 50% silica, about 12% sodium nitrate, about 4% sodium hexafluorosilicate, about 29% aluminum and about 5% iron oxide.

The particle size of the various components of the ignitor 70 are selected so that upon ignition, the ignitor 70 burns at a relatively slow rate, generally at a rate about 1 inch per 40 seconds. In the practice of the present invention, a burning rate of from about 5 to 60 seconds per inch is desirable with excellent results being achieved when the burning rate ranges from about 30 to 50 seconds per inch.

The particle size of the silica is such that at least 90% passes through a 20 mesh Tyler screen. In practice, the silica component is made up of two different mixes of silica particles. For example, a typical silica formulation comprises 90% of type A silica (as defined below) and 10% of type B silica (as defined below).

Type A Silica

About 0.8–1% retained on a 20 mesh screen
About 27% retained on a 30 mesh screen
About 62% retained on a 40 mesh screen
About 10% retained on a 50 mesh screen
About 0.2% retained on a 70 mesh screen
About trace retained on a 100 mesh screen
About trace retained on a 140 mesh screen Type B Silica About 0.3% retained on a 20 mesh screen
About 5.8% retained on a 30 mesh screen
About 21.4% retained on a 40 mesh screen
About 44.8% retained on a 50 mesh screen
About 21.5% retained on a 70 mesh screen
About 3.8% retained on a 100 mesh screen
About 1.6% retained on a 140 mesh screen
About 0.8% retained on a 200 mesh screen Both the sodium nitrate and the sodium hexafluorosilicate are sized such that they essentially all pass through an 80 mesh screen.

The iron powder is usually sized such that it passes through a 100 mesh screen.

The aluminum powder is sized such that it has a particle size ranging from about 0.01 to about 1.0 mm.

The various components of the ignitor 70 are mixed together and formed into the desired shape using a suitable binder. A typical binder is sodium silicate.

The ignitor 70 is fabricated so that its ignition temperature is in the range of about 1500° F. to about 2000° F. with the preferred ignition temperature being about 1750° F. Upon ignition, the ignitor 70 produces a temperature of about 2750° F. By utilizing an ignitor 70 of this type, it is possible to efficiently ignite a fuel such as charcoal, which is used for the purposes hereinbefore described.

In practice, the wick 74 and ignition cream 78 are generally composed of the same materials in the same relative amounts so that they will ignite at a low temperature, such as that generated by a match. Their most important feature is that they are applied to at least a portion of the surface of the ignitor 70. A typical ignition cream 78 comprises a mixture, in weight percent, of from about 10% to about 40% of an oxidizer, such as potassium nitrate ($KNO_3$), sodium nitrate ($NaNO_3$), manganese dioxide or the like, potassium perchlorate ($KClO_4$), potassium chlorate ($KClO_3$), from about 5% to about 30% aluminum, from about 10% to about 40% iron, from about 5% to about 40% silicon together with a suitable binder, such as from about 10% to about 40% polyurethane resin in a water emulsion or organic solvent.

The oxidizer is preferably employed in an amount ranging between about 30 to about 60 percent of stoichiometric (based on the amount of metal present). In practice, the preferred oxidizer is potassium perchlorate.

The metallic components are preferable utilized in powdered form. In this regard, it is preferred to use atomized aluminum, and powdered iron and silicon or ferrosilicon alloy.

The preferred binder is polyurethane, but other binders which may be employed include, acrylic emulsions, acrylic solutions with organic solvents, carboxymethyl cellulose, hydroxypropyl cellulose, hydroxyethel cellulose, polyvinyl alcohol, polysulfide, silicones, polyethyloxazoline, polyvinyl acetate, and polyamide resin.

The ignition cream 78 is compounded so that it will preferably ignite at a temperature of from about 500° F. to about 1000° F. and generate from about 2000° F. to about 3000° F. when burning. In one preferred embodiment, the ignition cream is ignited by a match flame and burns at a temperature sufficiently high to ignite thermite-like mixtures.

In addition to aiding ignition of the ignitor 70, the ignition cream 78 can serve to bond the wick 74 to the ignitor 70 and to the extension 62.

The invention has been described with reference to a preferred embodiment. Obviously, alterations and modifications will occur to others upon a reading and understanding of this specification. It is intended to include all such modifications and alterations insofar as they come within the scope of the appended claims or the equivalents thereof.

Having thus described the invention, it is now claimed:

1. An ignition device comprising:
a base comprised of a combustible material;
an ignitor comprised of a thermite material containing aluminum and iron oxide attached to said base; and,
an ignitable wick, attached to said base and said ignitor.

2. The ignition device of claim 1 wherein said wick comprises an ignitable composition including Al, Fe, Si, and $KClO_4$.

3. The ignition device of claim 2 wherein said wick further comprises a polyurethane binder.

4. The ignition device of claim 1 wherein said wick is resiliently flexible.

5. The ignition device of claim 1 further comprising an ignition cream joining said ignitor and said wick.

6. The ignition device of claim 5 wherein said ignition cream is an ignitable mixture including Al, Fe, Si, and $KClO_4$.

7. The ignition device of claim 5 wherein said ignition cream has the same chemical composition as said wick.

8. The ignition device of claim 1 wherein said ignitor is generally conically shaped.

9. The ignition device of claim 1 wherein said ignitor is shaped like a truncated cone.

10. An ignition device for use in igniting a fuel comprising:
a base;
an ignitor comprised of a thermite material including aluminum, iron oxide and sodium silicate binder;
a wick comprised of Al, Fe, Si, $KClO_4$ and a polyurethane binder; and,
an ignition cream attaching said wick to said ignitor.

11. The ignition device of claim 10 wherein said fuel is charcoal.

12. The ignition device of claim 10 wherein said ignitor further comprises particulates sized for a burning rate of between 5 seconds per inch and 60 seconds per inch.

13. The ignition device of claim 10 wherein said ignitor is shaped like a truncated cone.

14. An ignition device for use in igniting a fuel, comprising:
a base;
an ignitor comprised of a thermite material including aluminum, iron oxide and a sodium silicate binder;
a resilient wick; and, an ignition cream attaching said wick to said ignitor, said ignition cream being comprised of Al, Fe, Si, $KClO_4$ and a polyurethane binder.

15. The ignition device of claim 14 wherein said fuel is charcoal.

16. The ignition device of claim 14 wherein said ignitor further comprises particulates sized for a burning rate of between 5 seconds per inch and 60 seconds per inch.

17. The ignition device of claim 14 wherein said ignitor is shaped like a truncated cone.

* * * * *